US005297677A

United States Patent [19]

Burian et al.

[11] Patent Number: 5,297,677

[45] Date of Patent: Mar. 29, 1994

[54] SANITARY TOOTHBRUSH HOLDER

[76] Inventors: Alfred Burian; Edith E. Burian, both of 8 Putter La., Middle Island, N.Y. 11953

[21] Appl. No.: 32,854

[22] Filed: Mar. 15, 1993

[51] Int. Cl.[5] ..... B65D 83/10

[52] U.S. Cl. ..... 206/362.4; 206/362; 206/362.1; 206/485; 248/110; 248/174

[58] Field of Search ..... 206/361, 362, 362.1, 206/362.4, 485; 248/110, 174; 211/65, 72, 73

[56] References Cited

U.S. PATENT DOCUMENTS

| | | | |
|---|---|---|---|
| D. 270,878 | 10/1983 | Sabatella | D6/94 |
| 341,693 | 5/1886 | Roeseler . | |
| 918,372 | 4/1909 | Rohr | 206/362.1 |
| 1,463,805 | 8/1923 | Faber . | |
| 1,614,265 | 1/1927 | Stockton | 248/174 |
| 1,647,154 | 11/1927 | Soybel | 248/174 |
| 1,966,734 | 11/1932 | Rosen | 211/156 |
| 2,201,653 | 5/1940 | McCreary | 206/493 |
| 2,806,608 | 9/1957 | Collura | 248/174 |
| 2,957,584 | 10/1960 | Jenkins | 248/110 |
| 3,198,339 | 8/1965 | Stolarz | 211/49 |
| 3,390,783 | 7/1968 | Quackenbush, Jr. | 211/73 |
| 3,685,660 | 8/1972 | Saunders | 211/60 R |
| 3,731,333 | 5/1973 | Davis | 15/257 |
| 4,407,417 | 10/1983 | Boyle | 211/69.1 |
| 4,770,379 | 9/1988 | Estvoid | 211/65 |

*Primary Examiner*—David T. Fidei
*Attorney, Agent, or Firm*—James M. Trygg

[57] ABSTRACT

A sanitary toothbrush holder is disclosed that is assembled from a single piece of sheet material to form a stable holder which positions the bristle end of the toothbrush away from any support surfaces. The holder is capable of occupying a flat state for convenient storage and shipping and an assembled state where it is ready for use. The holder includes at least two panels that are hingedly attached. An opening is provided in one of the panels to loosely receive and position the toothbrush so that excess water will drain sway from the bristle end thereby enhancing proper drying.

11 Claims, 3 Drawing Sheets

SANITARY TOOTHBRUSH HOLDER

The present invention relates to a sanitary toothbrush holder which is easily assembled from a single piece of sheet material and after use is disassembled or crushed for easy disposal.

BACKGROUND OF INVENTION

Hotels and Inns which are open to the public attempt to provide the traveler with accommodations that are similar to those enjoyed by the traveler at home. The very nature of some of these accommodations renders them quite personal to many people. The cleanliness of the room and its furnishings are important as is their comfort and general physical condition which contributes to the overall attractiveness of the room. This overall attractiveness is directly translatable into satisfaction and enjoyment by the traveler who is staying there.

One problem faced by many travelers is finding a suitable place to temporarily store their toothbrushes immediately after use. To some, this is no problem at all, they simply lay in on the vanity counter top. However, to others, the thought of allowing the bristle end of their toothbrush to come into physical contact with a counter top that may have just been cleaned with unknown chemicals or even toxic substances perhaps, is simply not acceptable. For this reason the typical wall mounted toothbrush holder having through holes which allow the bristles of the brush to engage the holder is not acceptable either. There is probably nothing more personal to these people than their toothbrush because a toothbrush is used in ones mouth and a perception that the toothbrush is maintained in scrupulously sanitary conditions is paramount. Solutions to this problem may include placing the toothbrush into a glass tumbler with the bristle end facing upwardly or returning it to its travel container. The tumbler solution works as long as the tumbler is made of glass and has a substantial weight. However, many hotels and motels, in an effort to reduce operating costs, have replaced glass tumblers with throwaway light plastic ones. These are too lightweight to function as a toothbrush holder because the toothbrush, which weighs about as much as the plastic tumbler, has a tendency to lean outwardly beyond the edge of the tumbler rendering it off balance and unstable. Such an arrangement is easily knocked over by accident. The solution of returning the toothbrush to its travel container is not a perfect one either. Most such travel containers have limited provisions for air circulation so that when a toothbrush is returned to its container wet, it has little opportunity to properly dry. This, of course, is conducive to the development of mold, mildew, or other fungi in the travel container.

What is needed is a stable, toothbrush holder for hotels and the like that is perceived as being sanitary and that holds the bristle end away from all surfaces for proper drying.

SUMMARY OF THE INVENTION

The present invention is a sanitary toothbrush holder that is capable of occupying either a first position wherein the holder is substantially flat for shipping and storage and a second position wherein the toothbrush holder holds and positions at least a portion of a toothbrush away from a support surface upon which the holder rests. A first panel is provided having an outer surface facing substantially upwardly away from the support surface. An opening is provided in the first panel sized to loosely receive the toothbrush. A second panel is provided having a pair of opposite edges, one of which is hingedly attached to an edge of said first panel thereby forming a first fold line, and one of which is in supported contact with the support surface. Additional support means is provided in contact with the support surface for supporting the toothbrush holder in cooperation with one of the pair of opposite edges and for holding the toothbrush holder in the second position.

DESCRIPTION OF THE PREFERRED EMBODIMENT

Figure 1:
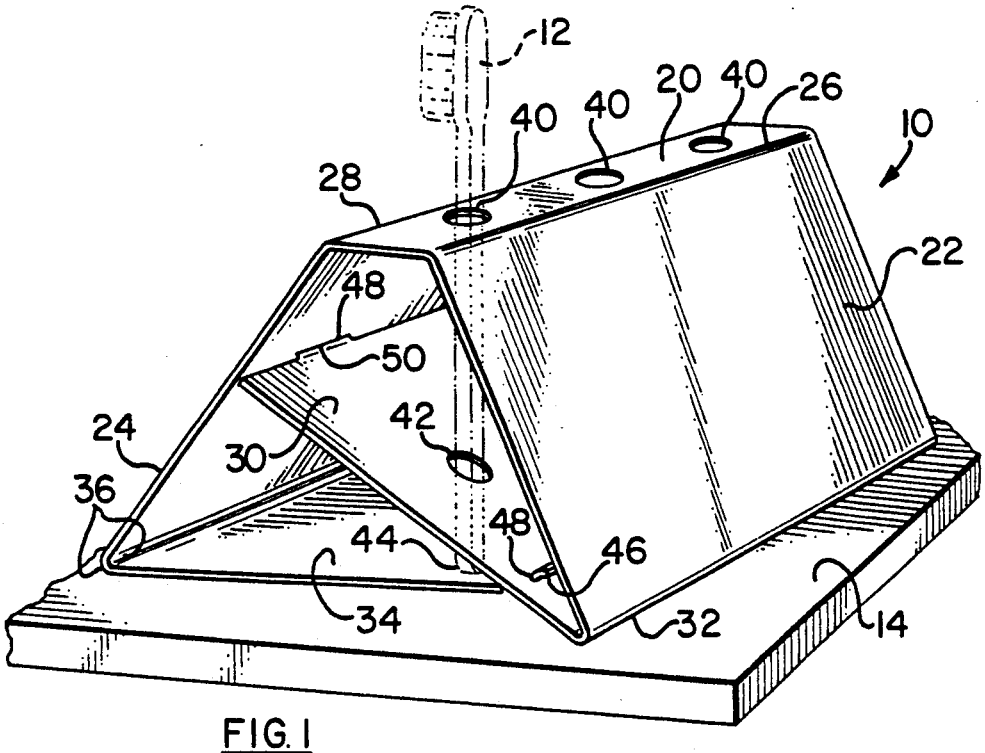
FIG. 1 is an isometric view of a toothbrush holder showing a first embodiment of the invention.
Figure 2:
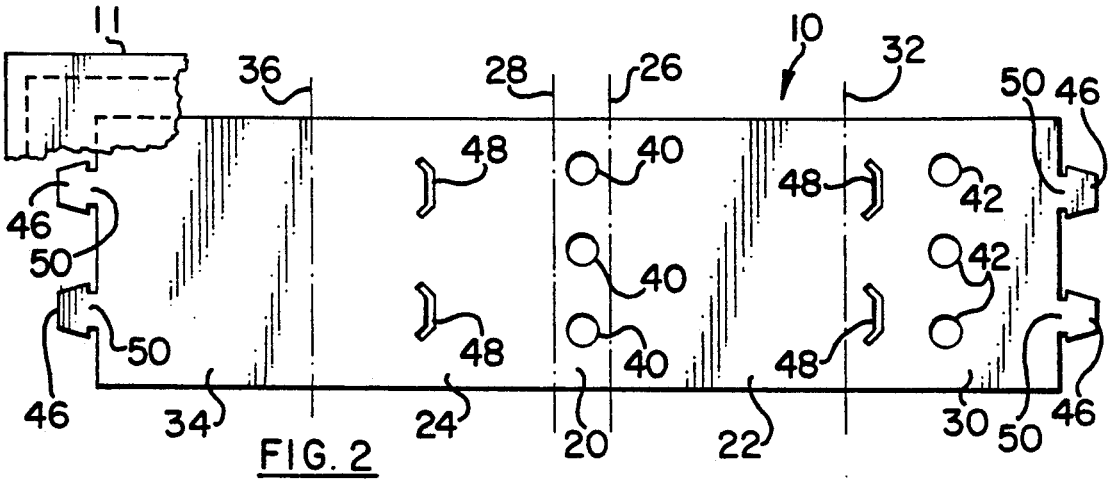
FIG. 2 is a plan view of a flat pattern for the toothbrush holder shown in FIG. 1.

There is shown in FIGS. 1 and 2 a first embodiment of a toothbrush holder 10 incorporating the teachings of the present invention. The holder 10 is shown in FIG. 2 in a first position where it is substantially flat, in the plane of the drawing, prior to assembly, this being the flat pattern form of the holder. In this first position, the holder 10 is protected by a sealed sanitary wrapper 11 which is easily removed and discarded prior to use. Such wrappers are usually made of a relatively thin plastic material in a manner that is well known in the industry. In this position, several of the holders 10 may be conveniently stacked for storage and shipping. The holder 10 is shown in FIG. 1 in a second position where it is in its assembled form showing a toothbrush 12, in phantom lines, being held substantially upright with respect to a vanity or table supporting surface 14.

The holder 10 includes a first panel 20 having an outer surface facing upwardly away from the support surface 14, a second panel 22, and a third panel 24. Each of the panels 22 and 24 have a pair of opposing edges, one such edge of the second panel 22 being hingedly attached to an edge of the first panel thereby forming a first fold line 26 and one such edge of the third panel 24 being hingedly attached to another edge of the first panel thereby forming a second fold line 28. A fourth panel 30 includes a pair of opposing edges one of which is hingedly attached to the edge of the second panel 22 that is opposite the first fold line 26 thereby forming a third fold line 32. The other opposite edge of the fourth panel 30 is attached to the third panel 24 in a manner that will be described below. A fifth panel 34 includes a pair of opposing edges, one of which is hingedly attached to the edge of the third panel 24 that is opposite the second fold line 28 thereby forming a fourth fold line 36. The other opposite edge of the fifth panel 34 is attached to the fourth panel 30 in a manner that will be described below. Note that the fold lines 26, 28, 32, and 36 are depicted by the indicated phantom lines in FIG. 2. The first panel 20 includes one or more spaced openings 40 sized to loosely receive the handle of the toothbrush 12. Additionally, the fourth panel 30 includes a similar number of openings 42 which are also sized to loosely receive the handle of the toothbrush 12. Each of the openings 42 is in substantial vertical alignment with a respective opening 40 so that the toothbrush 12 inserted into the two openings is held substantially vertical with respect to the support surface 14, as best seen in FIG. 1. In this position an end 44 of the toothbrush 12 engages the fifth panel 34 which substantially supports the weight of the toothbrush.

The other opposite edge of the fourth panel 30 is attached to the third panel 24 by means of one or more tabs 46 extending from the edge of the panel 30 and a like number of corresponding tab openings 48 formed in the third panel 24, as best seen in FIG. 2. The tabs 46 each include a shank portion 50 which is narrower than the tab. Each tab opening 48 is shaped and sized so that as a tab 46 is inserted into its respective tab opening, the tab is made to elastically deform while it conforms to the shape of the tab opening. When the tab 46 is fully inserted into the tab opening 48, the narrow shank portion enters the tab opening allowing the deformed portions of the tab to elastically return to substantially their original shape thereby locking the tab within the tab opening 48. Similarly, the other opposite edge of the fifth panel 34 is attached to the fourth panel 30 by means of one or more tabs 46 extending from the edge of the panel 34 and a like number of corresponding tabs openings 48 formed in the fourth panel 30. While the present example shown the tabs 46 having tapered sides and the tab openings 48 having angled ends for effecting elastic deformation of the tab when inserted into the tab openings, other suitable shapes may become apparent to one skilled in the art, all such shapes being considered within the present teachings. It will be understood that the edges of the fourth and fifth panels 30 and 34 respectively may be attached to their respective third and fourth panels 24 and 30 by any suitable means other than the tabs 46 and tab openings 48. Such means may include an adhesive strip along an appropriate surface of the one panel that engages the edge of the other panel. In this case the edge of the other panel may be bent to present more surface area in contact with the adhesive strips.

The exact placement of the slots 48 in the two panels 24 and 30 is not critical. However, they should be positioned so that the resulting structure is stable on the support surface 14. In the present example this is accomplished by positioning the tab openings 48 in the third panel 24 about midway between the second and fourth fold lines 28 and 36 respectively. The tab openings 48 are positioned in the fourth panel 30 between the third fold line 32 and the openings 42, but somewhat closer to the third fold line. This causes a portion of the fifth panel 34 to be directly under the openings 42 so that the end 44 of the toothbrush may be supported thereby. Additionally, this causes the fifth panel 34 to be angled with respect to the support surface 14 resulting in only two lines of contact with the support surface 14 for more stable support. The angled surface of the fifth panel 34 will direct excess water toward the fold line 36 and away from the end 44 of the toothbrush for enhanced drying of the toothbrush and will prevent water stains from occurring on the front surface 22.

Figure 3:
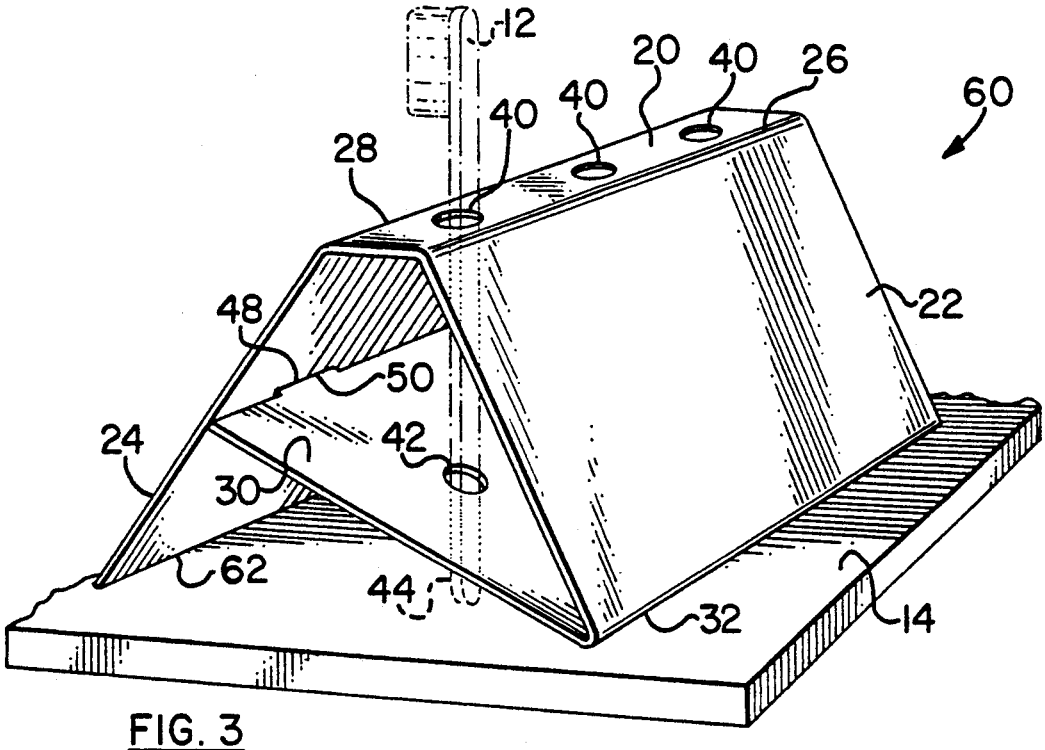
FIG. 3 is an isometric view of a toothbrush holder showing a second embodiment of the invention.
Figure 4:
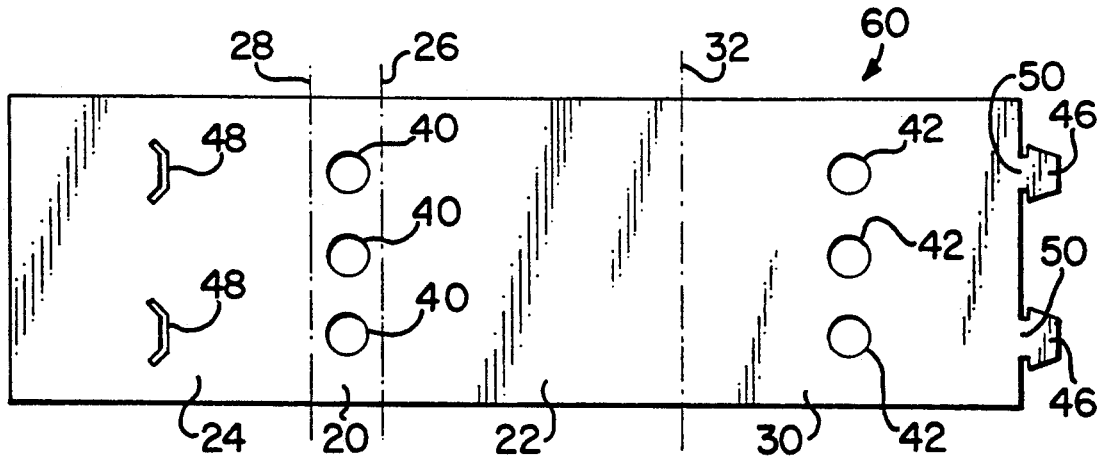
FIG. 4 is a plan view of a flat pattern for the toothbrush holder shown in FIG. 3.

There is shown in FIG. 3 and 4 a second embodiment of a toothbrush holder 60 incorporating the teachings of the present invention. The toothbrush holder 60 is similar to the holder 10 in that it includes the first, second, third, and fourth panels 20, 22, 24, and 30 respectively as well as the first, second and third fold lines 26, 28, and respectively. Openings 40 and 42 are formed in the first and fourth panels 20 and 30 in the same manner as in the holder 10. Additionally, the other opposite edge of the fourth panel 30 is attached to the approximate midpoint of the third panel 24 by means of the tabs 46 and tab openings 48. Unlike the toothbrush holder 10, the holder 60 has no equivalent of the fifth panel 34 and its associated tabs 46 and tab openings 48. Instead, the edge of the third panel 24 opposite the second fold line 28 is an edge 62 which is substantially coplanar with the third fold line 32, the edge 62 and the third fold line 32 being in supported engagement with the vanity or table support surface 14. In this embodiment the end 44 of the toothbrush 12 engages the surface 14, the weight of the toothbrush being substantially supported thereby. While this second embodiment lacks the advantage of draining excess water away from the end 44, it does have all the other advantages of the holder 10 of the first embodiment.

Figure 5:
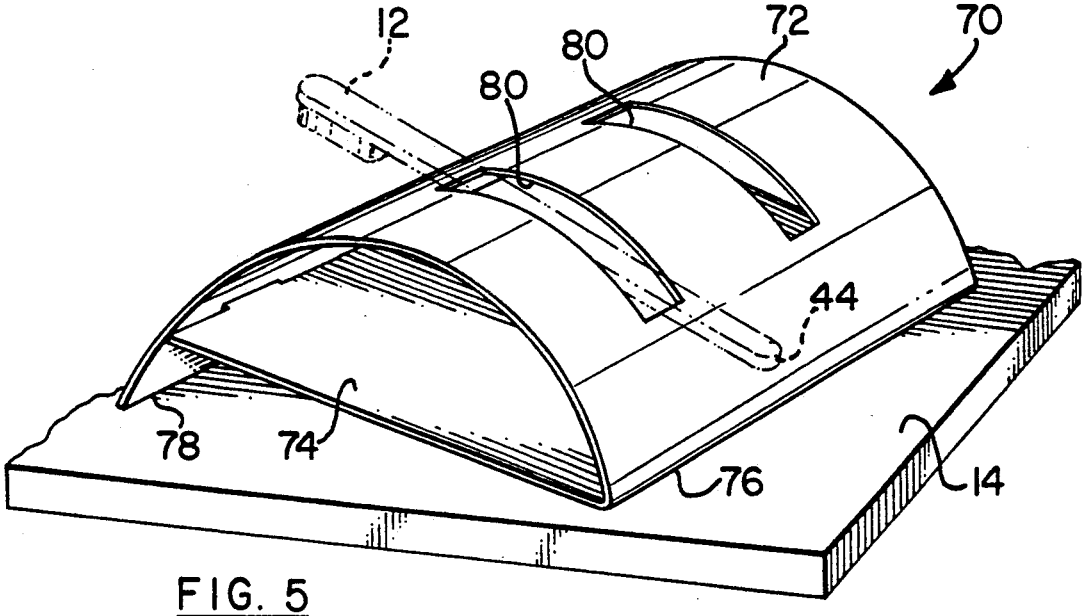
FIG. 5 is an isometric view of a toothbrush holder showing a third embodiment of the invention.
Figure 6:
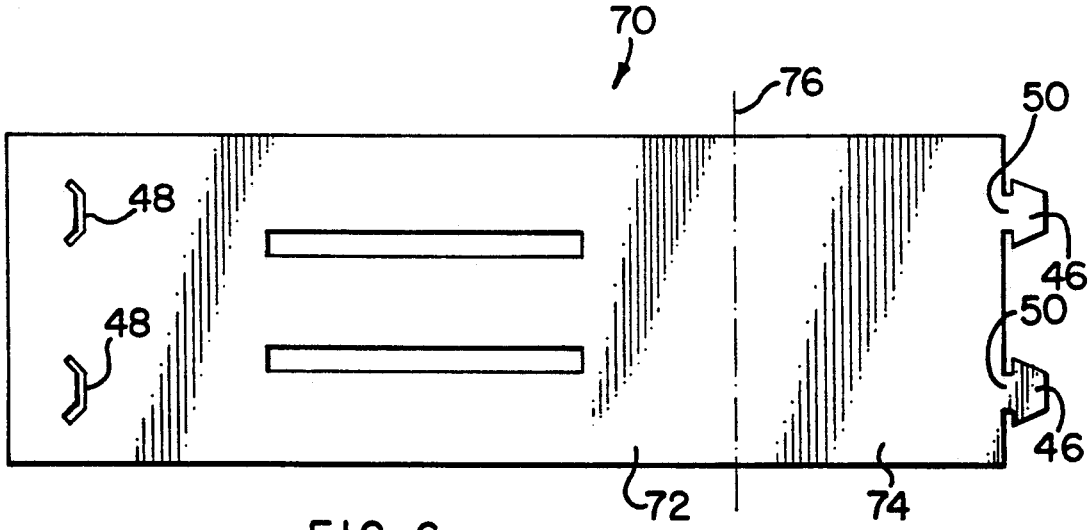
FIG. 6 is a plan view of a flat pattern for the toothbrush holder shown in FIG. 5.

There is shown in FIGS. 5 and 6 a third embodiment of a toothbrush holder 70 incorporating the teachings of the present invention. The holder 70 is shown in FIG. 6 in a first position where it is substantially flat, in the plane of the drawing, prior to assembly, this being the flat pattern form of the holder for convenient storage and shipping. The holder 70 is shown in FIG. 5 in a second position where it is in its assembled form showing a toothbrush 12, in phantom lines, being held somewhat horizontal with respect to the vanity or table supporting surface 14.

The holder 70 includes a first panel 72 having an outer surface facing upwardly away from the support surface 14 and a second panel 74 having a pair of opposing edges, one of which is hingedly attached to an edge of the first panel 72 thereby forming a first fold line 76. The other edge of the second panel 74 is attached to the first panel 72 by means of one or more tabs 46 and associated tab openings 48 in a manner similar to that of the toothbrush holder 10 and 60. The tabs 46 extend from the other edge of the second panel 74 as best seen in FIG. 6. The tab openings 48 are positioned in the first panel 72 near an end 78 opposite the first fold line 76 so that when the tabs 46 are fully inserted into their respective tab openings the first panel 72 is caused to bow or curve upwardly away from the support surface 14, in its second position as shown in FIG. 5. At least one opening 80 is formed in the first panel 72 to loosely receive and position the toothbrush 12, shown in phantom lines in FIG. 5. The opening 80 is arranged, in the present example, so that the toothbrush 12 is slanted somewhat with respect to the support surface 14, that is, the end 44 is closer to the surface than is the rest of the toothbrush. This tends to cause excess water to flow away from the bristles for proper drying. However, the opening 80 may be arranged so that the toothbrush 12 is substantially horizontal with respect to the support surface 14. Note that the curved surfaces of the first panel 72 that contact the toothbrush 12 will tend to guide excess water away from the toothbrush to enhance proper drying of the toothbrush. Since the second panel 74 is angled with respect to the support surface 14 there are only two lines of contact therewith, that being along the edge 78 and the fold line 76. This results in a more stable support for the holder 70.

Similar to the holder 10, the holders 60 and 70 may be placed in individual sanitary wrappers for shipping and storage. These wrappers are easily removed and discarded prior to use.

An important advantage of the toothbrush holder of the present invention is that the bristle end of the toothbrush is conveniently hold away from the supporting surface of the vanity to maintain the sanitary state of the toothbrush while allowing it to dry properly after use. Another important advantage is that the toothbrush holder occupies a first position where it is flat for convenient storage and shipping and then is easily manipulated to occupy its second position where it functions as a stable, sanitary toothbrush holder. Additionally, the used holder may be easily disassembled or simply crushed for discarding. The structures of the holders of the present invention are quite simple thereby rendering them easy to manufacture in a cost efficient manner.

We claim:

1. A sanitary toothbrush holder of unitary construction capable of occupying either of a first position wherein said holder is substantially flat for shipping and storage and a second position wherein said holder holds and positions at least a portion of a toothbrush away from a support surface upon which said holder rests, comprising:

(a) a first panel having an outer surface facing substantially upwardly away from said support surface;

(b) an opening in said first panel sized to loosely receive said toothbrush;

(c) a second panel having a pair of opposite edges, one of which is hingedly attached to an edge of said first panel thereby forming a first fold line, and one of which is in supported contact with said support surface; and (d) additional support means in contact with said support surface for supporting said toothbrush holder in cooperation with one of said pair of opposite edges and for holding said toothbrush holder in said second position including a third panel having a pair of opposite edges, one of which is hingedly attached to an edge of said first panel that is opposite said first fold line thereby forming a second fold of which is hingedly attached to an edge of said second panel that is opposite said first fold line thereby forming a third fold line and the other of which is attached to said third panel away from both said opposite edges of said third panel when said holder is in said second position.

2. The toothbrush holder according to claim 1 wherein said additional support means includes a fifth panel having a pair of opposite edges, one of which is hingedly attached to an edge of said third panel that is opposite said second fold line thereby forming a fourth fold line and the other of which is attached to said fourth panel away from both said opposite edges of said fourth panel when said holder is in said second position.

3. The toothbrush holder according to claim 2 wherein said fourth panel includes an opening therethrough sized to loosely receive said toothbrush, said opening being in substantial axial alignment with said opening in said first panel when said holder is in said second position so that a portion of said toothbrush extends through both said openings.

4. The toothbrush holder according to claim 3 wherein said other edge of said fifth panel attached to said fourth panel is thereby attached in a position so that when said portion of said toothbrush extends through both said openings, it engages and rests upon said fifth panel.

5. The toothbrush holder according to claim 2 wherein said other edge of said fourth panel includes a tab which is extendable through a tab opening in said third panel for effecting said attachment thereto and wherein said other edge of said fifth panel includes a tab which is extendable through a tab opening in said fourth panel for effecting said attachment thereto.

6. The toothbrush holder according to claim 5 wherein said tab openings in said third and fourth panels are shaped so that when said tabs are inserted to extend therethrough said tabs are elastically deformed.

7. The toothbrush holder according to claim 6 wherein each said tab includes a shank portion adjacent its respective said edge of said panel that is sized to extend through its respective tab opening without deformation so that when said tab is inserted into its respective tab opening the tab is elastically deformed until its shank portion enters the tab opening whereupon the deformed portion of said tab substantially returns to its non-deformed state whereby said tab is held captive within its respective tab opening.

8. The toothbrush holder according to claim 1 wherein said fourth panel includes an opening therethrough sized to loosely receive said toothbrush, said opening being in substantial axial alignment with said opening in said first panel so that a portion of said toothbrush extends through both said openings when said holder is in said second position.

9. The toothbrush holder according to claim 8 wherein said other edge of said fourth panel includes a tab which is extendable through a tab opening in said third panel for effecting said attachment thereto.

10. The toothbrush holder to claim 9 wherein said tab opening in said third panel is shaped so that when said tab is inserted to extend therethrough said tab is elastically deformed.

11. The toothbrush holder according to claim 10 wherein said tab includes a shank portion that is sized to extend through said tab opening without deformation so that when said tab is inserted into said opening the tab is elastically deformed until its shank portion enters the tab opening whereupon the deformed portion of said tab returns to its non-deformed state whereby said tab is held captive within its tab opening.

* * * * *